United States Patent [19]

Quinn et al.

[11] 4,234,128

[45] Nov. 18, 1980

[54] NOZZLE ASSEMBLY

[75] Inventors: David R. Quinn, Pembroke Pines; Walter H. Wesner, Plantation, both of Fla.

[73] Assignee: The AFA Corporation, Miami Lakes, Fla.

[21] Appl. No.: 875,357

[22] Filed: Feb. 6, 1978

[51] Int. Cl.[3] ..... B05B 1/12

[52] U.S. Cl. ..... 239/478; 239/538; 222/554

[58] Field of Search ..... 239/478, 479, 492, 538; 222/554, 548

[56] References Cited

U.S. PATENT DOCUMENTS

| | | | |
|---|---|---|---|
| 3,149,755 | 9/1964 | Porter et al. | 222/548 X |
| 3,967,765 | 7/1976 | Micallef | 239/478 X |

*Primary Examiner*—Robert W. Saifer

*Attorney, Agent, or Firm*—Thomas W. Brennan

[57] ABSTRACT

An adjustable nozzle assembly for a hand operated compression sprayer is disclosed. The nozzle is attached to the discharge end of the sprayer and is adjustable from an off position to two discharge positions, such as a spray position and a stream position. The nozzle and sprayer body have cooperating passages which, when brought into register by adjustment of the nozzle, determine the discharge mode (i.e., whether off, spray or stream).

17 Claims, 15 Drawing Figures

[OFF]

[STREAM]

[SPRAY]

[OFF]

[SPRAY]

[STREAM]

[OFF]

[SPRAY]

[STREAM]

NOZZLE ASSEMBLY

BACKGROUND OF THE INVENTION

1. Field of the Invention

This invention relates generally to nozzles for compression sprayers. More particularly, the invention relates to an improved multi-position nozzle assembly which can be adjusted between an off position and any of several different discharge or ejection positions.

2. Description of the Prior Art

Multi-position nozzles for compression sprayer are disclosed in U.S. Pat. Nos. 3,843,030 and 3,967,765 to L. A. Micallef, which patents issued on Oct. 22, 1974 and July 6, 1976, respectively. These patents represent the prior art over which the present invention is an improvement. The nozzles described in said patents are adjustable to three modes, off, spray and stream via four positions, there being an off position in both patented nozzles between each of the spray and stream positions.

The device of the first mentioned patent requires the presence of a cap or nozzle including a discharge orifice that is radially off-set in relation to the axis of an internal bore in a tubular member of the device, a slotted internal boss and respective inner end surfaces on the tubular member and the end wall of the nozzle to be properly aligned and oriented. The end surfaces cooperate to provide passage means and sealing surfaces in operation to close the bore when the nozzle is in the off position. This arrangement is often unsatisfactory for sealing purposes and results in undesirable cross-leakage through the nozzle.

The nozzle disclosed in the second mentioned patent requires the presence of an extra internal, thin-walled cylinder having slots provided therein for proper orientation and alignment. The slotted thin-walled cylinders can flex when the nozzle is in the off position, resulting in undesirable leakage through the nozzle. Further, the nozzle described in said patent uses two entrance passages which, together with the internal slotted cylinders, presents fabrication problems.

SUMMARY OF THE INVENTION

Among the objects of the present invention is the provision of an adjustable, multi-position nozzle assembly that is simpler in terms of fabrication and assembly than prior art nozzle assemblies and that employs improved inner and outer seals to prevent leakage.

A further object of the invention is to provide a multi-position nozzle assembly for a hand-operated liquid sprayer or dispenser pump in which a nozzle may be rotated about the discharge end of the dispenser pump from an "OFF" position where liquid is sealed to a plurality of other positions in sequence, in each of which other positions liquid is dispensed in a characteristic pattern.

In accomplishing these and other objects there is provided in accordance with the present invention an adjustable nozzle asembly for a hand-operated compression liquid dispenser or ejection device having a discharge end in which a centrally located core or plug is formed. A nozzle is coupled to the discharge end of the dispenser in liquid flow controlling relation with respect to the core or plug. The nozzle and discharge end of the dispenser are relatively rotatable, in sequence, from an OFF position in which liquid is sealed in the dispenser and the latter is disabled, to another one of a plurality of other positions, in each of which other positions liquid is discharged from the dispenser in a characteristically different discharge mode or pattern, for example, stream or spray. The nozzle and core or plug each have two contiguous surfaces that are arranged in embracing cooperative engaging relationship with the corresponding surface of the other. The contiguous surfaces of the nozzle comprise the inner wall of a concentrically located, generally cylindrical projection formed in the nozzle and the contained inner end wall of the nozzle. The nozzle cylinder is arranged in embracing contacting relation with the centrally located core or plug with an interference fit. The contiguous surfaces of the core or plug are the peripheral and end surfaces. Each of the contiguous surfaces of both the core or plug and the nozzle have passageways formed therein, which passageways when brought into register by relative adjustment of the nozzle and the core or plug determine the ejection or discharge mode of the dispenser.

There is thus provided a multi-position nozzle assembly of the character described which has fewer parts than prior art nozzle assemblies, each part, moreover, being individually less complex to form and less expensive to assemble and manufacture, resulting in minimum costs and maximum economy. The multi-position nozzle assembly of the present invention is further characterized by the provision of inner and outer positive seals which minimize or prevent leakage from the nozzle.

DETAILED DESCRIPTION OF THE PREFERRED EMBODIMENT

Figure 1:
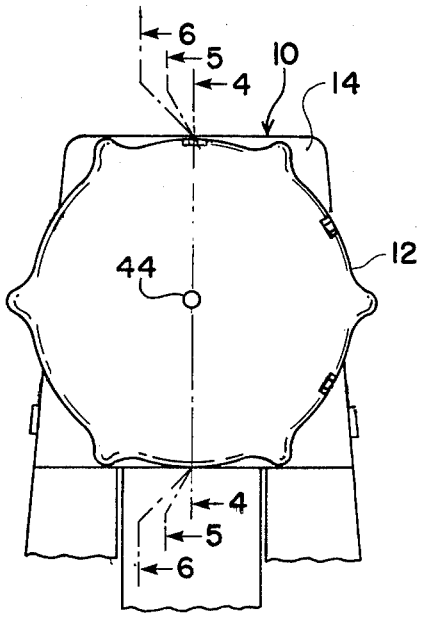
FIG. 1 is a front elevation of the nozzle assembly of the invention fitted on the nose or discharge end in the body of a manually operated compression sprayer.
Figure 2:
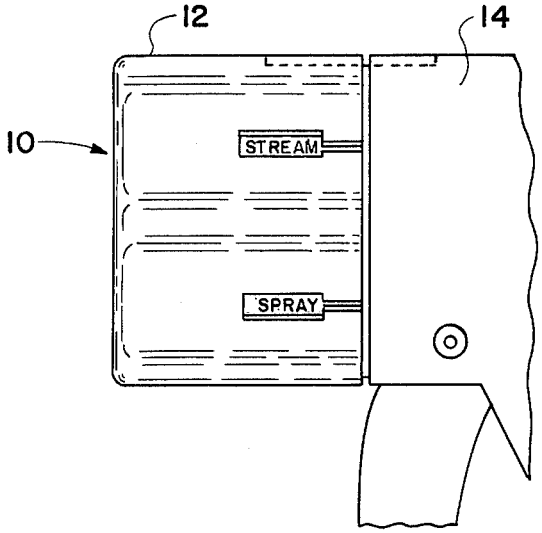
FIG. 2 is a side elevation of the nozzle assembly of the invention corresponding to FIG. 1, illustrating a method of indicating, by indexing, the several nozzle positions or adjustments.
Figure 3:
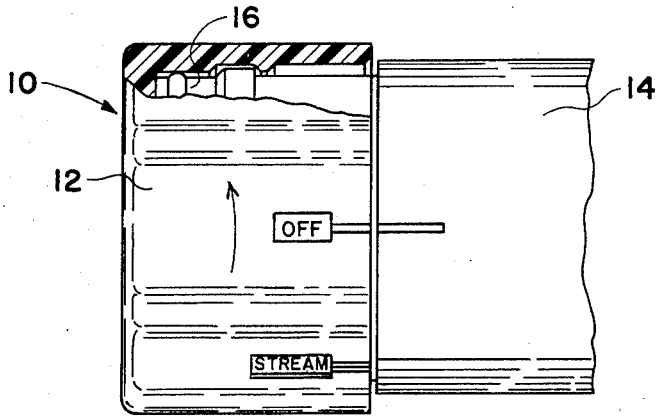
FIG. 3 is a top or plan view of the nozzle assembly of the invention as in FIGS. 1 and 2, adjusted to an OFF position.

Referring now to FIGS. 1–3, the exterior appearance of a preferred embodiment of the invention is illustrated. In this drawing a trigger actuated, hand-operated compression sprayer or ejection device 10 has an adjustable nozzle 12 assembled on the body 14 on the nose or discharge end 16 thereof.

Figure 4:
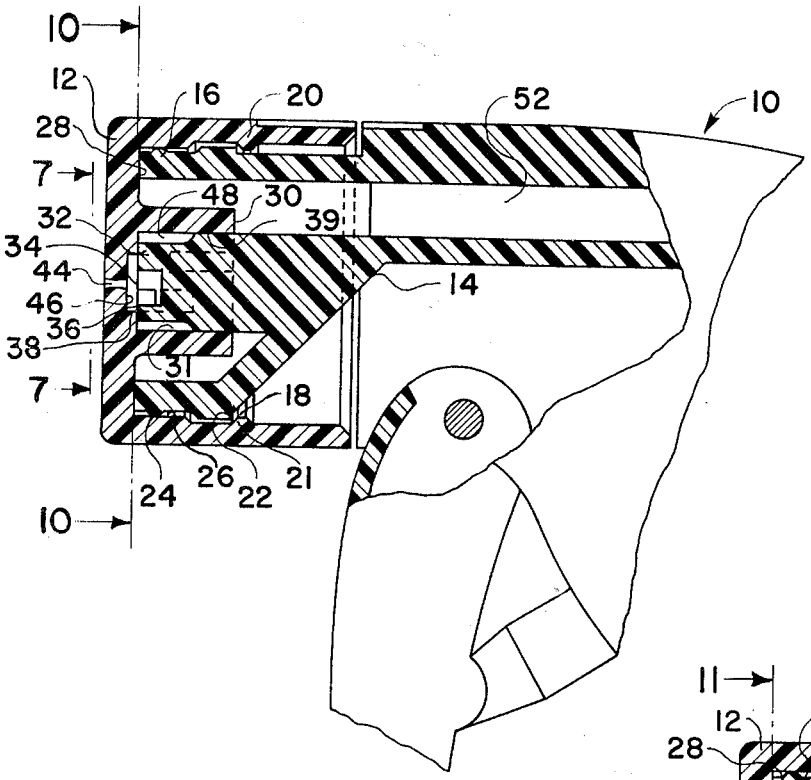
FIG. 4 is an elevational section of the nozzle assembly of the invention, adjusted to an OFF position, taken along line 4—4 of FIG. 1.
Figure 5:
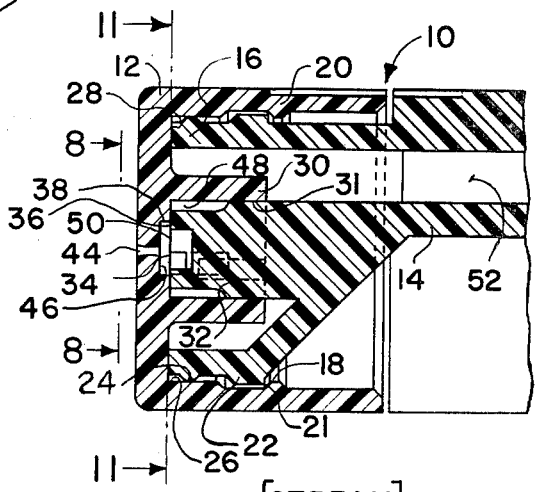
FIG. 5 is an elevational section of the nozzle assembly of the invention when adjusted to a STREAM position, taken along the line 5—5 of FIG. 1.
Figure 6:
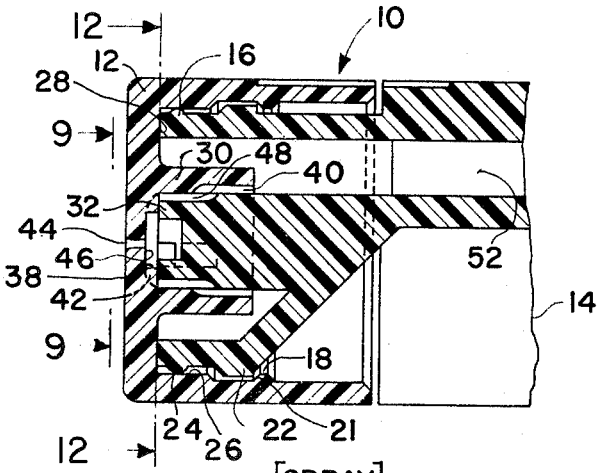
FIG. 6 is an elevational section of the nozzle assembly of the invention when adjusted to a SPRAY position, taken along line 6—6 of FIG. 1.

In FIGS. 4–6 of the drawings, nozzle 12 is fitted in rotating relation to body 14 on the nose or discharge end 16 thereof, and is retained thereon by engagement of the radially inwardly projecting ring or bead 18 formed on the inner surface of a sidewall or skirt 20 of nozzle 12 with the radially outwardly projecting wall surface 21 of a ridge 22 formed on the outer surface of body 14. Nozzle 12 is press fitted to body 14 until ring or bead 18, the inside diameter of which is less than the outside diameter of ridge 22, engages radial wall surface 21. Thus secured, nozzle 12, though restrained from moving axially on discharge end 16, is still free to rotate thereon.

An outer seal against leakage from nozzle 12 is provided by the half-round raised bead 24 formed on the forward outer surface of body 14 on discharge end 16 which seals against the adjacent inner forward cylindrical surface 26 of nozzle 12 sidewall or skirt 20, these members and parts being made to tolerances sufficiently close to insure an interference fit between them.

Nozzle 12 has an inner end wall 28 from the inner surface of which a projection in the form of an open cylinder 30 extends. Projection or cylinder 30 has an inner wall 31, the inner surface of which embraces in physical contiguous engaging relation, a core or plug 32 formed, in general, in the central part of discharge end 16. Core or plug 32 has an opening 34 in an annular end wall 36 which contacts substantially in contiguous relation the inner surface of end wall 28 in the bottom end of cylinder 30 on a shelf 38 thereat. Core or plug 32 is embraced by inner wall 31 of cylinder or projection 30 in interference fit relation and has an outer surface 39 physically engaging cylinder 30 on surface 31 thereof to provide a seal or liquid shut-off between them when the nozzle 12 is moved to an OFF position.

Figure 9:
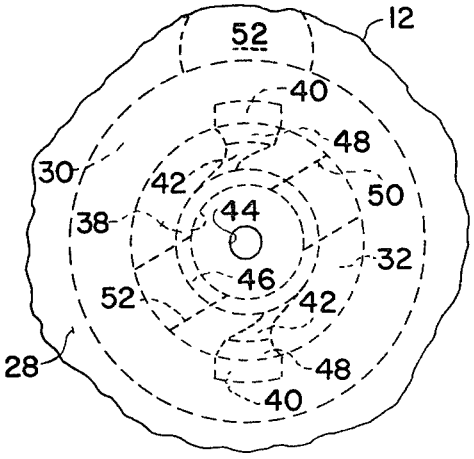
FIG. 9 is an enlarged, partial elevation of the nozzle assembly of the invention taken along line 9—9 of FIG. 6.

Cylinder 30 has a pair of axial passages or grooves 40, best seen in FIG. 6, oppositely disposed in inner wall 31 which, as will be appreciated from FIG. 9, are generally rectangular in cross-section and in length approximately half as long as wall 31 of cylinder 30. Shelf 38 in end wall 28 contains a pair of oppositely disposed, radius bottomed swirl or turn passages 42 which are substantially aligned with, although normally not in direct communication with axial passages 40 in the inner surface of wall 31. Aligned swirl or turn passages 42 rotate with cylinder 30 and grooves 40 when nozzle 12 is rotated.

A discharge orifice 44 is provided in the central portion of end wall 28 of nozzle 12 being formed in the bottom of a shallow cavity or chamber 46, also formed in end wall 28. Cavity or chamber 46 is defined by shelf 38 which surrounds it.

Core or plug 32 also has a pair of axial oppositely disposed passages or grooves 48, similar in cross-section and substantially equal in length to passages or grooves 40 in wall 31 of cylinder 30 which overlap these passages and in certain instances communicate with them. A pair of transverse through slots or passages 50, best seen in FIGS. 4 through 6 and 13, are located in opening 34 in the end wall 36 of core or plug 32 through wall 36. Slots 50 are cut in end wall 36 extending therein approximately one-half the length of groove or passage 48, at which point they are formed into grooves or steps for the remaining distance, and are circumferentially displaced from about 30° to about 60° therefrom. In a preferred arrangement the circumferential displacements of slots 50 from passages 48, is 60° as shown, by way of example, in FIG. 13.

Figure 7:
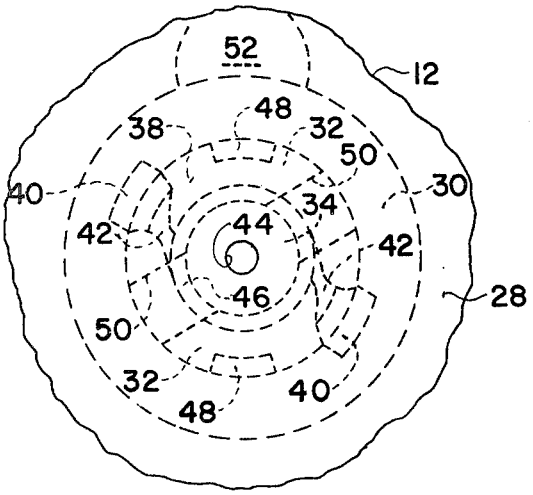
FIG. 7 is an enlarged, partial elevation of the nozzle assembly of the invention taken along line 7—7 of FIG. 4.
Figure 8:
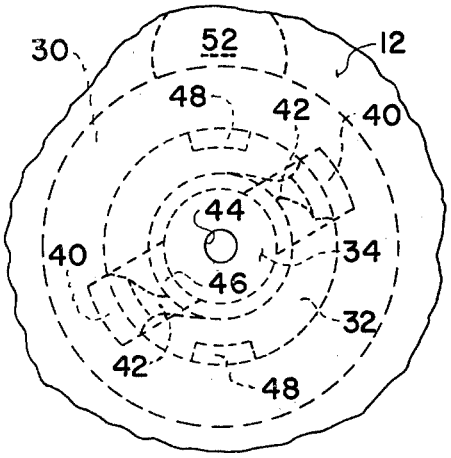
FIG. 8 is an enlarged, partial elevation of the nozzle assembly of the invention taken along line 8—8 of FIG. 5.
Figure 10:
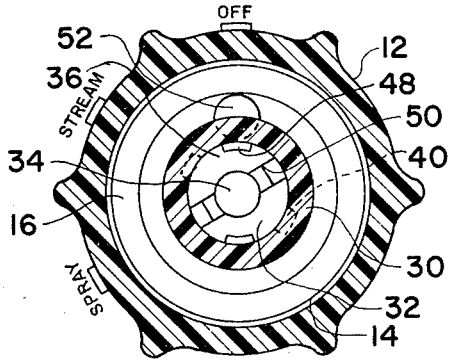
FIG. 10 is a front, elevational section along the line 10—10 of FIG. 4.
Figure 11:
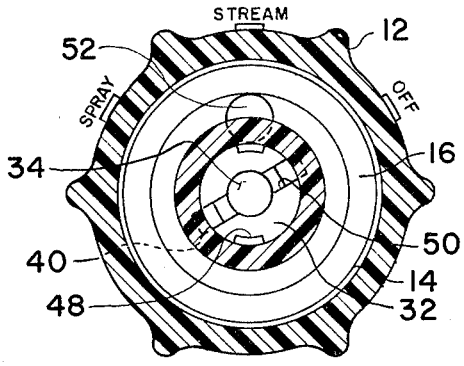
FIG. 11 is a front, elevational section along line 11—11 of FIG. 5.

Turning now to FIGS. 4 through 6, an entrance passageway 52 is provided in body 14 which is in communication with a liquid supply in a container (not shown) and which also communicates with the interior of nose or discharge end 16. As will be more fully explained hereinafter with reference to the description of the operation of the invention, nozzle 12 is assembled on ejection device 10 on discharge end 16 of body 14 thereof and can be adjusted relative to said discharge end 16 to any of a plurality of different positions in sequence whereby the passageways formed in the various surfaces of core or plug 32 and cylinder 30 may cooperate when brought into register to dispense or eject liquid at predetermined characteristic modes or patterns. In addition, at least one position to which nozzle assembly 12 is adjusted is an OFF position and liquid flow is shut-off, which is illustrated in FIGS. 4, 7 and 10. In FIGS. 5, 8 and 11, a STREAM position is illustrated, in FIGS. 6, 9 and 12, a SPRAY position is shown, and in FIGS. 1 through 3, by way of example only, a particular indexing method for indicating the various positions to which nozzle assembly 12 may be adjusted to dispense liquid in the particular characteristic ejection mode or pattern desired is illustrated.

In operation of the invention, reference being had to FIG. 3, nozzle assembly 12 is shown adjusted to a characteristic OFF position which is indicated by the index mark on body 14 registering with the OFF legend on nozzle 12. In FIGS. 4, 7 and 10, nozzle 12 is also shown adjusted to an OFF position and the positional relationships of the different surfaces and passages in this position are also illustrated. Thus, for example, passages 40 in cylinder 30 are not in register with either passages 48 or transverse slots 50, therefore cylinder 30 is in a position in which liquid communication between entrance passageway 52 and orifice 44 in chamber 46 is not obtained, and since cylinder 30 and core or plug 32 are assembled with an interference fit, seal 39 is formed between their respective and contiguous inner and outer peripheral surfaces which prevents liquid passage into cavity 46 and liquid ejection from orifice 44.

To initiate ejection or dispensing of liquid and with reference to FIGS. 5, 8 and 11, nozzle assembly 12 is adjusted on discharge end 16 by rotation through an angle of approximately 60° in the direction of the arrow, as seen in FIG. 3, until the legend STREAM is indexed. In this position, passages 40 in cylinder 30 are brought into register and aligned with transverse slots 50 in core or plug 32 and liquid flows through passages 40 from passageway 52 through slots 50 and into cavity or chamber 46 for ejection and discharge directly from orifice 44 and sprayer 10 in a characterized pattern of a stream.

Figure 12:
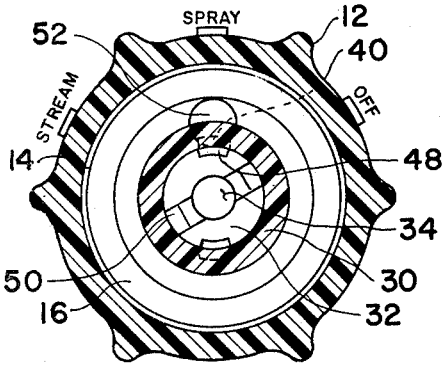
FIG. 12 is a front, elevational section along line 12—12 of FIG. 6.

To dispense liquid in a spray and with reference to FIGS. 6, 9 and 12, nozzle assembly 12 is adjusted on discharge end 16 by rotation through an additional angle of 60° (or 120° from the initial OFF position) in the direction of the arrow in FIG. 3 until the legend SPRAY is indexed. In this position, passages 40 in the inner surface of wall 31 of cylinder 30, which are always open to passageway 36, are aligned in overlapping communicating relation with passages or grooves 48 in the outer surface of core or plug 32. Simultaneously, since passages 40 are normally aligned with swirl or turn passages 42 in shelf 38, liquid communication between axial passages 40 and swirl passages 42 via axial passages 48 is effected and liquid can pass from entrance passageway 36 to cavity or chamber 46. The liquid passing through turn passages 42 is angularly accelerated and injected tangentially into cavity or chamber 46 and orifice 44 and ejected from sprayer 10 in a spray or divergent stream pattern.

Figure 14:
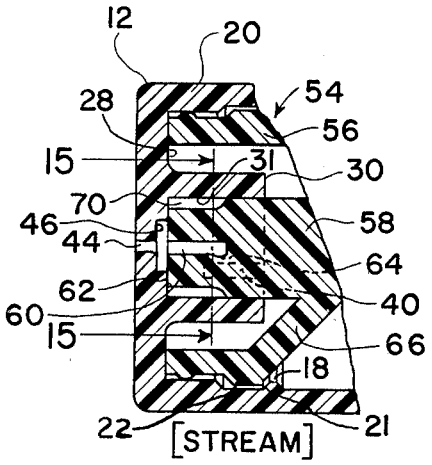
FIG. 14 is a partial, elevational section of an additional embodiment of the invention generally corresponding to FIG. 5 with respect to the adjustment of the nozzle assembly, and, FIG. 15 is a section taken along line 15—15 of FIG. 14.
Figure 15:
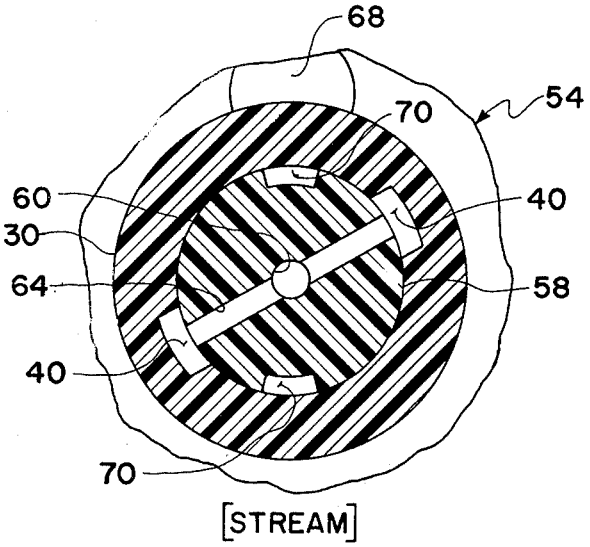

Turning now to FIGS. 14 and 15, an additional embodiment of the invention comprising a compression sprayer 54 will be described. In FIG. 14 sprayer 54 has a discharge end 56 which is similar in construction to discharge end 16 of the preferred embodiment except for a slightly modified centrally located plug 58 included therein. Modified plug 58 has a passage similar to passage 48 formed in its outer peripheral surfaces, which surfaces are also contiguous with the embracing surfaces of wall 31 of cylinder 30. Nozzle assembly 12 is coupled, by press fitting, to discharge end 56 and is retained thereon by the same means, i.e., engagement of bead 18 in the inner surface of skirt or sidewall 20 with surface 21 of ridge 22, also formed on discharge end 56, as in the preferred embodiment.

Plug 58 has an internal axial bore 60 in the surface of an end wall 62 thereof. Bore 60 extends into end wall 62 a distance equal in length, or to a depth equal to the length or depth of transverse slots 50 of the preferred embodiment and communicates with an internal transverse bore 64 in plug 58, which is registerable with passages 40 in cylinder 30.

In the illustration of FIGS. 14 and 15, nozzle assembly 12 is adjusted by rotation until indexed at a STREAM position, in which position passages 40 of cylinder 30 are brought into register with transverse bore 64 and communication between passages 40 and axial bore 60 is thereby established.

The body 66 of sprayer 54 has an entrance passageway 68 which communicates with a liquid supply (not shown) and with passages 40 in cylinder 30, the latter passage, as in the previous embodiment, being at all times open to passageway 68. Liquid from passageway 68 can now flow directly into nozzle 12 cavity 46 via axial passages 40, transverse bore 64 and central bore 60 from where it can flow into cavity 46 and through orifice 44 and be ejected from sprayer 54 in a pattern or mode characterized as a stream.

It will be appreciated from the foregoing that in this embodiment, as in the preferred embodiment, nozzle 12 and discharge end 56 are movable into different positions of relative adjustment, passageways 40, bores 60 and 64 being formed in the respective surfaces of plug 58 and cylinder 30 to cooperate when brought into register by relative adjustment of nozzle 12 and discharge end 56 to provide other ejection or discharge modes. For example, plug 58 also has a pair of oppositely disposed axial passages or grooves 70 which are similar or identical to passages 48 of core or plug 32 and which, when brought into register by rotation and indexing of nozzle 12 with passages 40 in cylinder 30, will effect communication between entrance passageway 68 and turn passages 42 in shelf 38 to eject liquid in a mode or pattern characterized as a spray. In addition, a further adjustment by rotation and indexing of nozzle 12 relative to discharge end 56, will provide a liquid shut-off position.

From the foregoing description it is readily appreciated that the present invention is an improvement over prior compression sprayers with adjustable multi-purpose nozzles in that, for one example, it can be more easily and therefore more economically fabricated particularly when molded since certain molding problems inherent in prior devices are avoided or otherwise overcome. Other not necessarily the only advantages worthy of specific mention are the following:

(a) significant decreases in liquid pressure drop throughout or across the sprayer are obtained owing to the arrangement of surfaces and passages which are straighter, more direct and less tortuous compared to prior art devices;

(b) in each adjusted position in which liquid is ejected in an individually characterized mode, an individual, discrete liquid conduit, or flow path, is provided, which is not present in prior devices;

(c) positive outer static seals to prevent liquid leakage from the device and inner seals to prevent internal cross leakage are provided which are absent in prior devices; and, (d) a single entrance or liquid supply passage to promote pumping efficiency is provided not always present in prior devices.

Although the present invention has been described in terms of a preferred working cycle which has 60° between positions, other cycles are possible, for example, a cycle with 30° between positions or one with 90° between positions. Still others will occur to the skilled artisan in using the invention.

What is claimed is:

1. An adjustable nozzle assembly for a hand-operated compression liquid ejection device, said device including a discharge end in which a core having a plurality of surfaces is formed, a nozzle coupled to said device discharge end, said nozzle having an inner end wall surface from which a projection extends, said projection having formed thereon a core embracing inner wall surface, said inner end wall surface and said embracing surface being disposed in liquid flow controlling relation with respect to said surface portions of said core, said nozzle and said device discharge end being movable into different positions of relative adjustment including a liquid flow OFF position, the surfaces of said core and the inner surfaces of said nozzle having passagesways formed therein including at least two ejection or discharge mode characterizing passageways whereby an individually characterized device ejection or discharge mode is established in each of two other different positions of relative adjustment when said passageways are brought into register by relative adjustment of said nozzle and said device discharge end to determine the ejection or discharge mode of said device.

2. An adjustable nozzle assembly as specified in claim 1 including other surfaces formed in said nozzle and on said device discharge end, said other surfaces being in sliding contact with each other and cooperating to provide a static seal between said nozzle and said device discharge end whereby leakage therebetween is prevented in the OFF position of relative adjustment of said nozzle and said device discharge end.

3. An adjustable nozzle assembly for a hand-operated compression liquid ejection device, the device including a discharge end wherein a core having a plurality of contiguous surfaces is formed, a nozzle coupled to said device discharge end, said nozzle having an inner end wall surface from which a projection extends, said projection having formed thereon a core embracing inner wall contiguous surface, said inner end wall and said embracing surface being disposed to engage an individually associated one of said contiguous surfaces of said core in liquid flow controlling relation, said nozzle and said device discharge end being movable into different positions of relative adjustment including at least one liquid flow OFF position, and passageways formed in said surfaces of said core and of said nozzle at least two of which passageways being ejection or discharge mode characterizing passageways which cooperate when brought into register by relative adjustment of said nozzle and said device discharge end to determine the ejection or discharge mode of the device said ejection or discharge mode characterizing passageways being formed in a surface of said nozzle whereby an individually characterized device ejection or discharge mode is established in each of two of said different positions of relative adjustment of said nozzle and said device discharge end.

4. An adjustable nozzle assembly for hand-operated compression liquid ejection device, the device having a discharge end portion including a plug formed therein, a nozzle coupled to said discharge end portion and having a plug embracing portion disposed in liquid flow control relation with respect to said plug, said nozzle and device discharge end being movable into different positions of relative adjustment including a liquid flow OFF position, said nozzle portion and plug each having a plurality of contiguous surfaces that are in cooperative sliding engagement with the surfaces of the other, in which surfaces passageways are formed which passageways when brought into register by relative adjustment of said nozzle and said discharge end determine the ejection or discharge mode of the device and, at least two of said passageways formed in one of said contiguous surfaces whereby an individually characterized device ejection or discharge mode is established in each of two other different positions of relative adjustment of said nozzle and said device discharge end.

5. An adjustable nozzle assembly for a hand-operated compression liquid ejection device, the device having a discharge end in which a plug is formed, a nozzle coupled to said device discharge end and disposed in liquid flow controlling relation with respect to said plug, said nozzle and device discharge end being relatively movable in sequence, from an OFF position in which said device is disabled, to another one of a plurality of different positions, each of which different positions provides an individually characterized device ejection or discharge mode or pattern, said nozzle and said plug each having a plurality of contiguous surfaces that are disposed in cooperative relation with the surfaces of the other, each of said surfaces having passageways formed therein, which passageways when brought into register by relative adjustment of said nozzle and said device discharge end determine the ejection or discharge mode of said device.

6. An adjustable nozzle assembly as specified in claim 5 including other surfaces formed in said nozzle and on said device discharge end, said other surfaces being in sliding contact with each other and cooperating to provide a seal between said nozzle and said device discharge end whereby leakage therebetween is prevented in the OFF position of relative adjustment of said nozzle and said device discharge end.

7. An adjustable nozzle assembly as specified in claim 5 wherein said nozzle includes an end wall on which a cylinder is formed, wherein said plug is cylindrical in form and is disposed in said cylinder for relative rotative sliding contact of the cylindrical walls of said cylinder and of said plug, an end wall of said plug being in sliding contact with said end wall of said nozzle, the surfaces of said nozzle end wall, of said plug end wall and of the cylindrical walls of said cylinder and plug comprising said cooperating contiguous surfaces.

8. An adjustable nozzle assembly as specified in claim 7 wherein a surface of the inner wall of said cylinder and a surface of the cylindrical wall of said plug cooperate to provide a seal therebetween in the OFF position of relative adjustment of said nozzle and said device discharge end.

9. An adjustable nozzle assembly as specified in claim 8 including other cooperating surfaces provided on said nozzle and on said device discharge end providing a seal therebetween to prevent leakage between said device discharge end and said nozzle in the OFF position of relative adjustment of said nozzle and said device discharge end.

10. An adjustable nozzle assembly as specified in claim 7 wherein said nozzle end wall includes a chamber formed therein, a discharge orifice located within said chamber, and a shelf portion substantially surrounding said chamber and having at least one swirl passage, said swirl passage having a tangential outlet on said chamber.

11. An adjustable nozzle assembly as specified in claim 10 wherein said plug has a discharge end in which an opening is formed and has oppositely disposed passages formed in the outer peripheral surface thereof which extend rearwardly from said opening in said discharge end in overlapping communicating relation with passages in the walls of said cylinder when the position of relative adjustment of said nozzle and said device discharge end is one of said plurality of different positions thereby providing a characterized device ejection or discharge mode.

12. An adjustable nozzle assembly as specified in claim 5 wherein said nozzle has an end wall and said cooperating contiguous surfaces include the inner wall of a cylinder formed on said nozzle end wall and an outer wall of said plug, said plug being engaged in said cylinder for relative rotative sliding contact.

13. An adjustable nozzle assembly as specified in claim 12 wherein said plug has a discharge end disposed in sliding contact with said nozzle end wall, and wherein said cooperating contiguous surfaces include said nozzle end wall and the end of said plug.

14. An adjustable nozzle assembly as specified in claim 13 wherein said nozzle end wall includes a chamber formed therein, a discharge orifice located within said chamber, and a shelf portion substantially surrounding said chamber and having at least one swirl passage, said swirl passage having a tangential outlet in said chamber.

15. An adjustable nozzle assembly as specified in claim 14 wherein said plug has a discharge end in which an opening is formed and has oppositely disposed passages formed in the outer peripheral surface thereto which extend rearwardly from said opening in said discharge end in overlapping communicating relation with passages in the walls of said cylinder when the position of relative adjustment of said nozzle and said discharge end portion is one of said plurality of different positions thereby providing a characterized device ejection or discharge mode.

16. An adjustable nozzle assembly as specified in claim 5 including other surfaces provided on said nozzle and on said device discharge end, said surfaces being in contact with each other and cooperating to provide a seal between said nozzle and said discharge end portion whereby leakage therebetween is prevented in the OFF position of relative adjustment of said nozzle and said discharge end portion.

17. An adjustable nozzle assembly for a hand-operated compression liquid ejection device, the device having a discharge end, a nozzle coupled to and embracing said device discharge end, and device discharge end being relatively adjustable, in sequence, from an OFF position in which said device is disabled, to another one of a plurality of different positions each of which different positions provides an individually characterized device ejection or discharge mode or pattern, said nozzle and said device discharge end each having two contiguous surfaces that are disposed in cooperative relation with the contiguous surfaces of the other, in each of which surface passageways are formed, which passageways when brought into register by relative adjustment of said nozzle and said device discharge end determine the discharge mode of said device.

* * * * *

UNITED STATES PATENT OFFICE

CERTIFICATE OF CORRECTION

Patent No. 4,234,128 Dated November 18, 1980

Inventor(s) David R. Quinn and Walter H. Wesner

Figure 13:
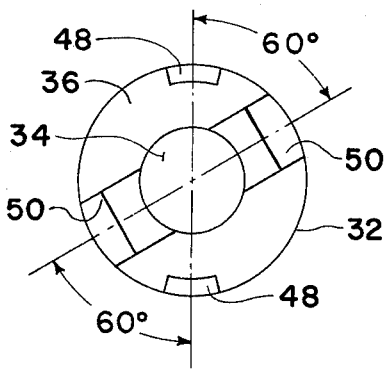
FIG. 13 is an end elevation of a detail of a core or plug of the invention viewed from the discharge end.

It is certified that error appears in the above-identified patent and that said Letters Patent are hereby corrected as shown below:

IN THE DRAWINGS:

Figs. 4 and 6, reference numeral "50" and lead line added as per copy of drawing sheet attached;

Fig. 5, extended lead line for reference numeral "50"; added reference numeral "40" and lead line, as per copy of sheet attached;

Fig. 13, extended lead line for reference numeral "50", both occurrences, as per copy of sheet attached;

Figs. 10, 11 and 12 should appear as shown on attached copy of drawing sheet.

Signed and Sealed this

*Twenty-first* Day of *July 1981*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,234,128

DATED : November 18, 1980

INVENTOR(S) : David R. Quinn et al.

It is certified that error appears in the above—identified patent and that said Letters Patent is hereby corrected as shown below:

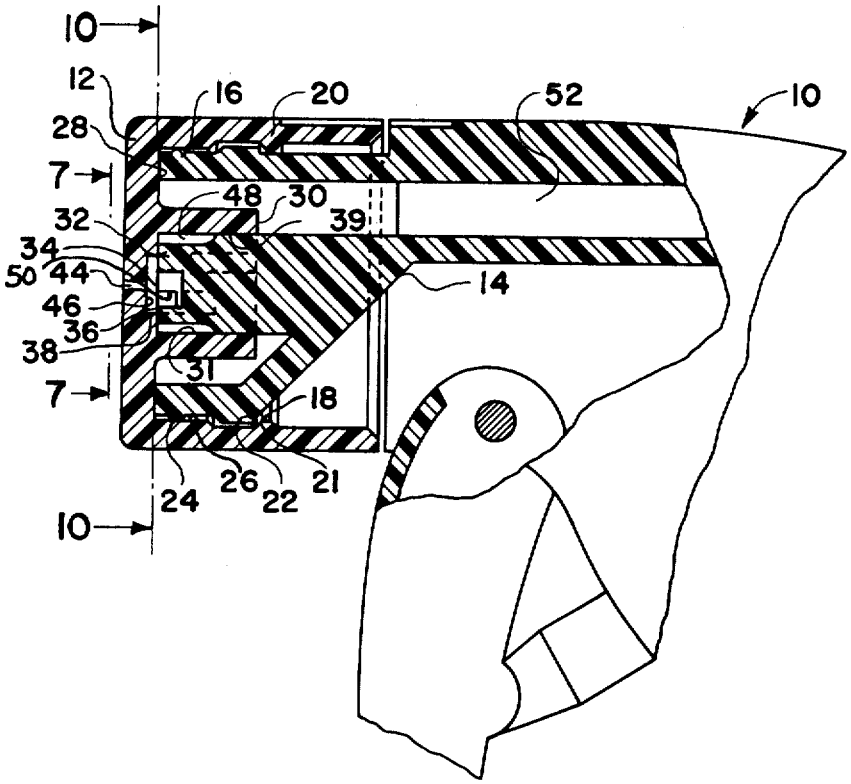

[OFF]

FIG. 4

UNITED STATES PATENT AND TRADEMARK OFFICE

CERTIFICATE OF CORRECTION

PATENT NO. : 4,234,128 Page 3 of 5

DATED : November 18, 1980

INVENTOR(S) : David R. Quinn et al.

It is certified that error appears in the above—identified patent and that said Letters Patent is hereby corrected as shown below:

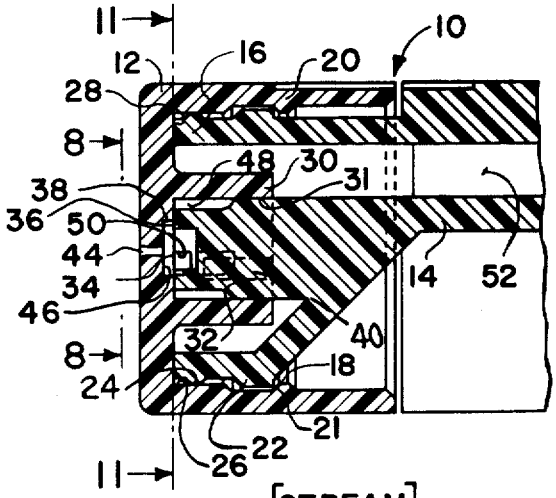

[STREAM]

FIG. 5

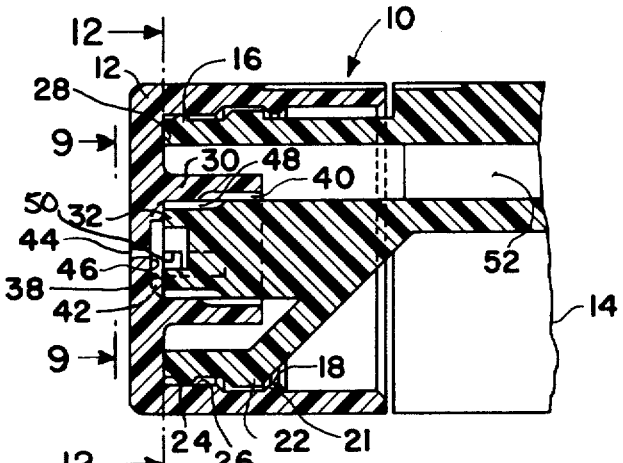

[SPRAY]

FIG. 6

UNITED STATES PATENT AND TRADEMARK OFFICE

CERTIFICATE OF CORRECTION

PATENT NO. : 4,234,128 Page 4 of 5

DATED : November 18, 1980

INVENTOR(S) : David R. Quinn et al.

It is certified that error appears in the above—identified patent and that said Letters Patent is hereby corrected as shown below:

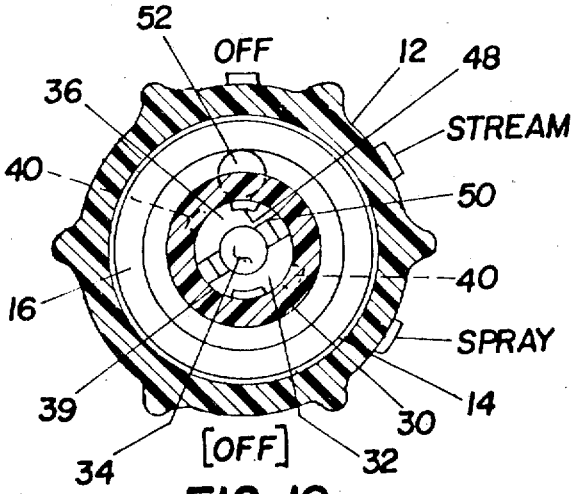

FIG. 10

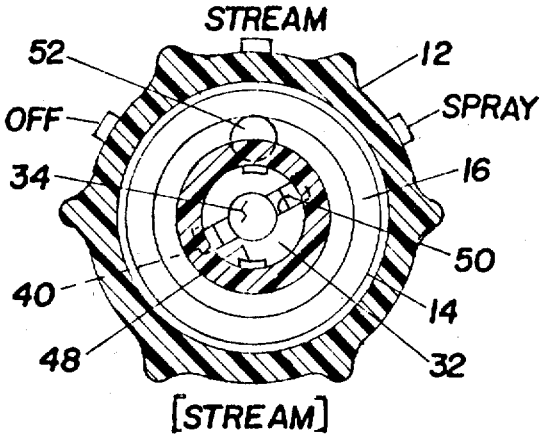

FIG. 11

UNITED STATES PATENT AND TRADEMARK OFFICE

CERTIFICATE OF CORRECTION

PATENT NO. : 4,234,128

DATED : November 18, 1980

INVENTOR(S) : David R. Quinn et al.

It is certified that error appears in the above—identified patent and that said Letters Patent is hereby corrected as shown below:

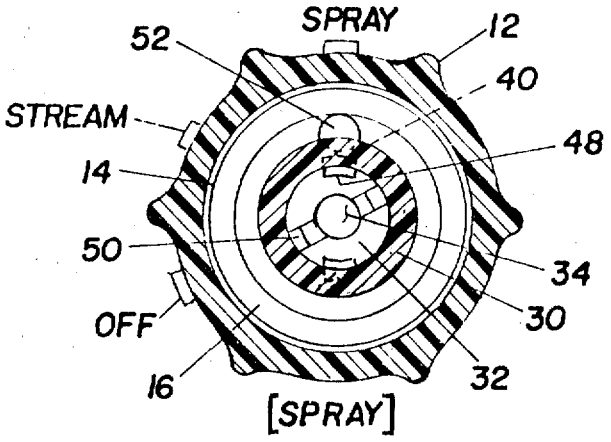

[SPRAY]

FIG. 12

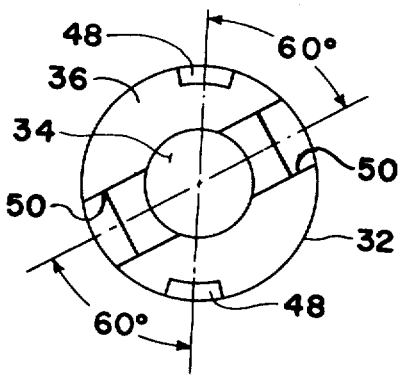

FIG. 13